US008450255B2

(12) United States Patent
Ikeda et al.

(10) Patent No.: US 8,450,255 B2
(45) Date of Patent: May 28, 2013

(54) FUNCTIONAL FLUID

(75) Inventors: Masahiko Ikeda, Aichi (JP); Susie Hurley, Duffield (GB); William D. Abraham, Concord, OH (US); James L. Sumiejski, Mentor, OH (US); Craig D. Tipton, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 376 days.

(21) Appl. No.: 12/516,650

(22) PCT Filed: Dec. 13, 2007

(86) PCT No.: PCT/US2007/087426

§ 371 (c)(1),
(2), (4) Date: Jan. 12, 2010

(87) PCT Pub. No.: WO2008/076825

PCT Pub. Date: Jun. 26, 2008

(65) Prior Publication Data

US 2010/0144565 A1 Jun. 10, 2010

Related U.S. Application Data

(60) Provisional application No. 60/870,425, filed on Dec. 18, 2006.

(51) Int. Cl.

| | |
|---|---|
| ***C10M 173/00*** | (2006.01) |
| ***C10M 159/12*** | (2006.01) |
| ***C10M 135/18*** | (2006.01) |
| ***C10M 159/24*** | (2006.01) |

(52) U.S. Cl.
USPC ..... 508/391; 508/335; 508/356; 508/363

(58) Field of Classification Search
USPC ..... 508/161, 391, 335, 356, 363
See application file for complete search history.

(56) References Cited

U.S. PATENT DOCUMENTS 4,512,903 A 4/1985 Schlicht et al.
4,525,288 A * 6/1985 Schlicht ..... 508/555

(Continued)

FOREIGN PATENT DOCUMENTS

EP 1279721 1/2003
EP 1803796 7/2007

(Continued)

OTHER PUBLICATIONS

Corresponding PCT Publication No. WO 2008/076825 A1, including Search Report, published Jun. 26, 2008.

(Continued)

*Primary Examiner* — Prem C Singh
*Assistant Examiner* — Francis C Campanell
(74) *Attorney, Agent, or Firm* — David M. Shold; Michael F. Esposito

(57) ABSTRACT

The disclosed invention relates to a functional fluid comprising: at least one oil of lubricating viscosity; at least one detergent, the detergent contributing an amount of metal to the functional fluid equal to a concentration in the range from about 0.015 to about 1% by weight of the functional fluid, the detergent contributing an amount of basicity to the functional fluid equal to a total base number in the range from about 0.3 to about 2; and at least one friction modifier, the friction modifier comprising at least two hydrocarbyl groups attached to a polar group or atom (eg., a nitrogen atom).

15 Claims, 7 Drawing Sheets

U.S. PATENT DOCUMENTS

| | | | | |
|---|---|---|---|---|
| 5,395,539 | A | 3/1995 | Chandler et al. | |
| 5,484,543 | A | 1/1996 | Chandler et al. | |
| 5,556,569 | A | 9/1996 | Huang | |
| 5,750,476 | A | 5/1998 | Nibert et al. | |
| 5,759,965 | A | 6/1998 | Sumiejski | |
| 5,840,663 | A | 11/1998 | Nibert et al. | |
| 5,858,929 | A * | 1/1999 | Sumiejski et al. | 508/162 |
| 5,942,472 | A | 8/1999 | Watts et al. | |
| 6,337,309 | B1 | 1/2002 | Watts et al. | |
| 6,426,323 | B1 | 7/2002 | Sato et al. | |
| 6,660,695 | B2 | 12/2003 | Watts et al. | |
| 2004/0192562 | A1 | 9/2004 | Morita | |
| 2005/0014656 | A1 | 1/2005 | Sumiejski et al. | |
| 2005/0041395 | A1 | 2/2005 | Tipton et al. | |
| 2005/0250655 | A1 * | 11/2005 | Adams et al. | 508/287 |
| 2006/0084583 | A1 | 4/2006 | Tipton et al. | |

FOREIGN PATENT DOCUMENTS

| | | |
|---|---|---|
| WO | 2004007652 | 1/2004 |
| WO | 2006045044 | 4/2006 |
| WO | 2006091387 | 8/2006 |
| WO | 2007044820 | 4/2007 |

OTHER PUBLICATIONS

Corresponding Written Opinion of international application No. PCT/US2007/087426 completed May 9, 2008.

* cited by examiner

FUNCTIONAL FLUID

This application claims priority under 35 U.S.C. §119(e) to U.S. Provisional Application Ser. No. 60/870,425 filed Dec. 18, 2006. The disclosure in this prior application is incorporated herein by reference.

TECHNICAL FIELD

The disclosed invention relates to functional fluids.

BACKGROUND

Functional fluids used as automatic transmission fluids (ATFs), traction fluids, fluids for continuously variable transmission fluids (CVTs), dual clutch automatic transmission fluids, farm tractor fluids, manual transmission fluids, fluids for hybrid vehicle transmissions, gear oils, and the like, are known.

SUMMARY

In the automatic transmission marketplace, there are rapid engineering changes driven by the desire to reduce weight and increase transmission capacity. This has resulted in two competing problems in the formulation of properly performing automatic transmission fluids. First, there is the problem of providing automatic transmission fluids that exhibit a high static coefficient of friction for improved clutch holding capacity. At the same time, there is the competing problem of providing automatic transmission fluids that improve the retention of positive slope characteristics in the μ/v (coefficient of friction vs. sliding speed) curve. The disclosed invention provides a solution to these problems.

The disclosed invention relates to a functional fluid comprising: at least one oil of lubricating viscosity; at least one detergent, the detergent contributing an amount of metal to the functional fluid equal to a concentration in the range from about 0.015 to about 1% by weight of the functional fluid, the detergent contributing an amount of basicity to the functional fluid equal to a total base number in the range from about 0.3 to about 2; and at least one friction modifier, the friction modifier comprising at least two hydrocarbyl groups attached to a polar group or atom (e.g., a nitrogen atom), the friction modifier being (a) the reaction product of at least one carboxylic acid or equivalent with at least one aminoalcohol, (b) the reaction product of at least one carboxylic acid or equivalent with at least one polyamine, (c) an amide or thioamide represented by the formula $$R^1R^2N—C(X)R^3$$

wherein X is O or S, $R^1$ and $R^2$ are each independently hydrocarbyl groups of at least about 6 carbon atoms, and $R^3$ is a hydroxyalkyl group of 1 to about 6 carbon atoms or a group formed by the condensation of the hydroxyalkyl group, through a hydroxyl group thereof, with an acylating agent, (d) at least one tertiary amine containing two hydrocarbyl groups and a polyhydroxyl-containing alkyl group or a polyhydroxyl-containing alkoxyalkyl group, or (e) a mixture of two or more of (a), (b), (c) and (d). The invention relates to concentrates for use in making the foregoing functional fluid.

The functional fluid may further comprise one or more dispersants, viscosity modifiers, dispersant viscosity modifiers, friction stabilizing agents, antiwear agents, phosphorus adjustment agents, supplemental friction modifiers, antioxidants, corrosion inhibitors, seal swell agents, pour point depressants, dyes, fluidizing agents, odor masking agents, foam inhibitors, diluent oils, or a mixture of two or more of any of the foregoing.

DETAILED DESCRIPTION

Figure 1:
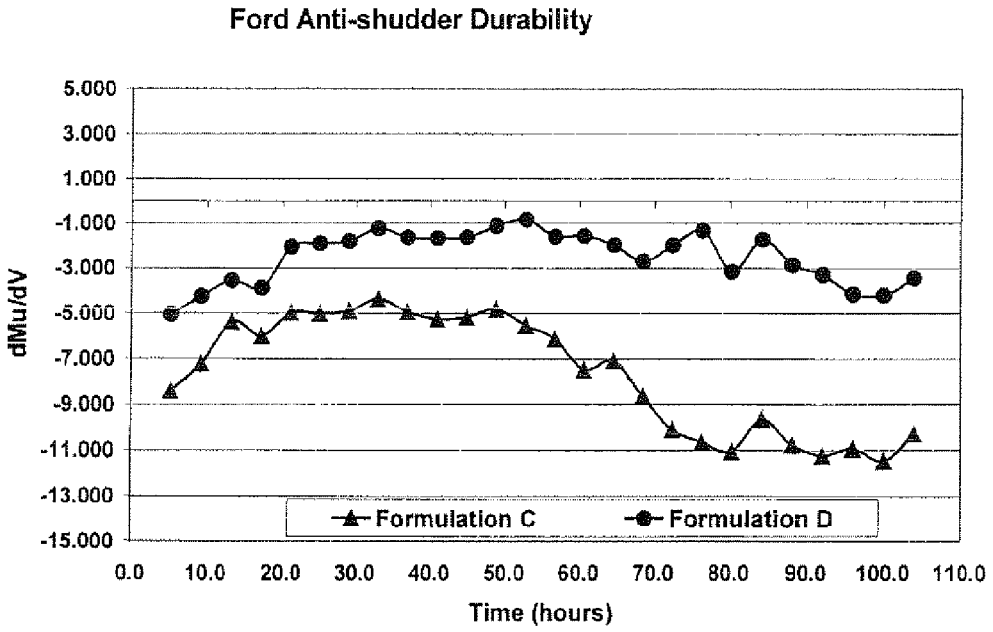
FIG. 1 is a graph showing the results of the Ford Anti-Shudder Durability Test for formulations C and D in the Example.

The term "functional fluid" is used herein to refer to automatic transmission fluids (ATFs), traction fluids, fluids for continuously variable transmission fluids (CVTs), dual clutch automatic transmission fluids, farm tractor fluids, manual transmission fluids, fluids for hybrid vehicle transmissions, gear oils, engine oils or lubricants, and the like. In one embodiment, the functional fluid is an ATF. In one embodiment, the functional fluid is a CVT.

The term "overbased" is a term of art which is generic to well known classes of metal containing compositions comprising metal salts and/or metal complexes. These compositions may also be referred to as "basic," "superbased," "hyperbased," "high-metal containing salts," and the like. Overbased metal compositions may be in the form of organic liquid compositions characterized by a metal content in excess of that which would be present according to the stoichiometry of the metal (e.g., calcium) and the particular acidic organic compound (e.g., sulfonic acid) reacted with the metal. Thus, for example, if a sulfonic acid is neutralized with a basic metal compound (e.g., calcium oxide), the "neutral" or "normal" metal salt produced will contain one equivalent of calcium for each equivalent of acid. On the other hand, an overbased metal composition will contain more than the stoichiometric amount of the metal. For example, a sulfonic acid may be reacted with a calcium base and the resulting overbased calcium sulfonate may contain an amount of calcium in excess of that necessary to neutralize the acid, for example, about 1.15 times as much calcium as present in the neutral salt or a calcium excess of about 0.15 equivalents.

The term "metal ratio" may be used herein to designate the ratio of the total chemical equivalents of metal (i.e., calcium) in an overbased composition (e.g., overbased calcium sulfonate) to the chemical equivalents of the metal in the corresponding neutral salt. Thus, for example, the metal ratio for a neutral calcium sulfonate is 1:1, and the metal ratio for the overbased calcium sulfonate with a metal excess of 0.15 equivalents discussed above is 1.15:1.

The term "TBN" may be used herein to refer to total base number. The total base number is the amount of acid (perchloric or hydrochloric) needed to neutralize all or part of a material's basicity, expressed as milligrams of KOH per gram of sample. The total base number or TBN contributed to a functional fluid by a detergent pursuant to the disclosed technology may or may not represent the TBN for the entire functional fluid since other ingredients may also contribute basicity (or TBN) to the functional fluid.

The term "hydrocarbyl," when referring to groups attached to the remainder of a molecule, may refer to groups having a purely hydrocarbon or predominantly hydrocarbon character. These groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, may be present for each 10 carbon atoms in the hydrocarbyl group.

The term "lower" as used herein in conjunction with terms such as hydrocarbyl, alkyl, alkenyl, alkoxy, and the like, may describe such groups which contain a total of up to 7 carbon atoms.

The term "oil-soluble" may refer to a material that is soluble in mineral oil to the extent of at least about 50 parts per million (ppm) at 25° C.

The oil of lubricating viscosity may comprise one or more natural oils, one or more synthetic oils, or a mixtures of two or more thereof. In a fully formulated functional fluid, the oil of lubricating viscosity may be present in a major amount (e.g., an amount greater than about 50% by weight). Typically, the oil of lubricating viscosity may be present at a concentration of at least about 75% by weight of the functional fluid, and in one embodiment at a concentration in the range from about 75% to about 95% by weight of the functional fluid. For concentrates, the oil of lubricating viscosity may be present at lower concentration or in a minor amount, for example, from about 10 to about 50% by weight, and in one embodiment from about 10 to about 30% by weight.

Natural oils that may be used may include animal oils and vegetable oils as well as mineral lubricating oils. The mineral oils may include liquid petroleum oils and solvent-treated or acid-treated mineral lubricating oils of the paraffinic, naphthenic or mixed paraffinic/-naphthenic types. These may be further refined by hydrocracking and hydrofinishing processes.

Synthetic lubricating oils may include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included may be alkylene oxide polymers and interpolymers and derivatives thereof, in which the terminal hydroxyl groups may have been modified by esterification or etherification. Also included may be esters of dicarboxylic acids with a variety of alcohols, or esters made from $C_5$ to $C_{12}$ monocarboxylic acids and polyols or polyol ethers. Other synthetic oils may include silicon-based oils, liquid esters of phosphorus-containing acids, and polymeric tetrahydrofurans. The synthetic oils may be produced by Fischer-Tropsch reactions and typically may comprise hydroisomerized Fischer-Tropsch hydrocarbons and/or waxes.

Unrefined, refined and rerefined oils, either natural or synthetic, may be used. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation. Rerefined oils are obtained by processes similar to those used to obtain refined oils applied to refined oils which have been already used in service. The rerefined oils may also be known as reclaimed or reprocessed oils and often are additionally processed by techniques directed to removal of spent additives and oil breakdown products.

The oil of lubricating viscosity may be an API Group II, Group III, Group IV, or Group V oil, including a synthetic oil, or mixtures thereof. These are classifications established by the API Base Oil Interchangeability Guidelines. Both Group II and Group III oils contain <0.03 percent sulfur and >99 percent saturates. Group II oils have a viscosity index of 80 to 120, and Group III oils have a viscosity index >120. Polyalphaolefins are categorized as Group IV. The oil can also be an oil derived from hydroisomerization of wax such as slack wax or a Fischer-Tropsch synthesized wax. Group V encompasses "all others" (except for Group I, which contains >0.03% S and/or <90% saturates and has a viscosity index of 80 to 120).

In one embodiment, at least about 50% by weight of the oil of lubricating viscosity may comprise one or more polyalphaolefins (PAO). The polyalphaolefins may be derived from monomers having from about 4 to about 30 carbon atoms, and in one embodiment from about 4 to about 20, and in one embodiment from about 6 to about 16 carbon atoms. Examples of useful PAOs may include those derived from 1-decene. These PAOs may have a viscosity in the range from about 1.5 to about 150 $mm^2/s$ (cSt) at 100° C. The PAOs may comprise hydrogenated materials.

The oil of lubricating viscosity may comprise an oil with a single viscosity range or it may comprise a mixture of high viscosity and low viscosity range oils. In one embodiment, the oil may exhibit a 100° C. kinematic viscosity in the range from about 1 to about 10 $mm^2/sec$ (cSt), and in one embodiment in the range from about 1 to about 8 $mm^2/sec$, and in one embodiment in the range from about 2 to about 10 $mm^2/sec$, and in one embodiment in the range from about 2 to about 8 $mm^2/sec$. The overall functional fluid may be formulated using oil and other components such that the viscosity at 100° C. is in the range from about 1 to about 20 $mm^2/sec$, and in one embodiment in the range from about 1 to about 15 $mm^2/sec$, and in one embodiment in the range from about 1 to about 10 $mm^2/sec$, and in one embodiment in the range from about 1.5 to about 20 $mm^2/sec$, and in one embodiment in the range from about 1.5 to about 15 $mm^2/sec$, and in one embodiment in the range from about 1.5 to about 10 $mm^2/sec$. The Brookfield viscosity (ASTM-D-2983) at −40° C. may be in the range up to about 20 or about 15 Pa-s (20,000 cP or 15,000 cP), and in one embodiment up to about 10 Pa-s, and in one embodiment up to about 5 Pa-s.

The detergent may comprise one or more metal salts of one or more organic acids. The organic acid portion of the detergent may comprise a sulfonate, carboxylate, phenate, salicylate, or a mixture of two or more thereof. The metal portion of the detergent may comprise an alkali or alkaline earth metal. The metal may be sodium, calcium, potassium and/or magnesium. The detergent may comprise calcium sulfonate. The metal salts may be neutral and/or overbased salts.

The overbased organic salt may comprise one or more sulfonate salts having a substantially oleophilic character formed from organic materials. The sulfonate compound may contain on average from about 10 to about 40 carbon atoms, and in one embodiment from about 12 to about 36 carbon atoms, and in one embodiment from about 14 to about 32 carbon atoms. The carbon atoms may be provided in either aromatic or in paraffinic configurations. Alkylated aromatics be employed. The aromatic of the alkylated aromatic may comprise a benzene moiety. Naphthalene based compounds may be employed. The phenates, salicylates, and carboxylates may have similar configurations and substantially oleophilic character.

An overbased monosulfonated alkylated benzene may be used. The alkylated benzene may comprise a monoalkylated benzene or a dialkylated benzene, with the monoalkylated benzenes being especially useful. Alkyl benzene fractions may be obtained from still bottom sources which may be mono- and/or di-alkylated.

A mixture of monoalkylated aromatics (benzene) may be utilized to obtain the mono-alkylated salt (e.g., monoalkylated benzene sulfonate). Mixtures wherein a substantial portion of the composition contains polymers of propylene as the source of the alkyl groups may assist in the solubility of the salt.

The excess metal from the overbased salts may provide the advantage of neutralizing acids which may build up in the functional fluid. Another advantage may be that the overbased salt may increase the dynamic coefficient of friction. The excess metal may be present over that which would be required to neutralize the anion at a ratio of up to about 30:1, and in one embodiment in the range from about 5:1 to about 18:1 on an equivalent basis.

Borated and non-borated overbased detergents may be used. These are described in U.S. Pat. Nos. 5,403,501 and 4,792,410 which are herein incorporated by reference for disclosure pertinent hereto.

The amount of metal (e.g., calcium) contributed to the fully formulated functional fluid by the detergent or mixture of detergents may be in the range from about 0.015 to about 1% by weight of the fully formulated functional fluid, and in one embodiment in the range from about 0.02 to about 1% by weight, and in one embodiment in the range from about 0.03 to about 1% by weight, and in one embodiment in the range from about 0.035 to about 0.08% by weight, and in one embodiment in the range from about 0.045 to about 0.06% by weight.

The TBN contributed to the fully formulated functional fluid by the detergent or mixture of detergents may be in the range from about 0.3 to about 2, and in one embodiment in the range from about 0.35 to about 1.5, and in one embodiment in the range from about 0.4 to about 1.

The amount of the detergent (i.e., neutral or overbased salt composition) utilized in the fully formulated functional fluid may be in the range from about 0.025 to about 3% by weight on an oil free basis, and in one embodiment in the range from about 0.1 to about 1% by weight.

The friction modifier comprises at least two hydrocarbyl groups, for example, alkyl groups, attached to a polar group or atom (e.g., a nitrogen atom). In order to assure a reasonable degree of oil solubility, the two hydrocarbyl groups may, together, contain a total of at least about 8 carbon atoms, and in one embodiment at least about 12 or at least about 16 carbon atoms. Each of the hydrocarbyl groups may be a long chain alkyl group containing, individually, at least about 6 or at least about 8 carbon atoms, such as from about 10 to about 30, or from about 12 to about 24, or from about 14 to about 20, or from about 16 to about 18 carbon atoms. The friction modifier may comprise (a) the reaction product of at least one carboxylic acid or equivalent (anhydride, acid halide, ester) with at least one aminoalochol; (b) the reaction product of at least one carboxylic acid or equivalent with at least one polyamine, (c) an amide or thioamide represented by the formula $$R^1R^2N—C(X)R^3$$

wherein X is O or S, $R^1$ and $R^2$ are each independently hydrocarbyl groups of, for example, at least about 6 carbon atoms, and $R^3$ is a hydroxyalkyl group of, for example, 1 to about 6 carbon atoms or a group formed by the condensation of the hydroxyalkyl group, through a hydroxyl group thereof, with an acylating agent, (d) at least one tertiary amine containing two hydrocarbyl groups and a polyhydroxyl-containing alkyl group or a polyhydroxyl-containing alkoxyalkyl group, or (e) a mixture of two or more of (a), (b), (c) and (d).

The friction modifier (a) may comprise one or more of the following condensation products: isostearic acid/trishydroxymethylamino methane ("THAM") (2:1 mole ratio); isostearic acid/2-amino-2-ethyl-1,3-propanediol (2:1 mole ratio); octadecyl succinic anhydride/ethanol amine/isostearic acid (1:1:1 mole ratio); or any of the foregoing materials combined with propylene oxide, for example, in a 1:1 mole ratio. In certain embodiments one or two of the components of the condensation product may contain branched chains.

In each type of condensation product, the carboxylic acids or equivalents may be as shown in the specific examples, or be a similar carboxylic acid derived from fatty acids from natural plant and animal oils or synthetically produced. They are, generally, in the about 8 to about 30 carbon atom range and are substantially linear in character. Alternatively, they may contain from about 10 to about 24 carbon atoms, or from about 12 to about 22 carbon atoms, or from about 16 to 20 carbon atoms. The carboxylic acids or equivalents may be linear or branched. Examples may include stearic acid, palmitic acid, oleic acid, tall oil acids, acids derived from the oxidation of hydrocarbons, substituted succinic acids, ether-acids derived from the addition of acrylates or methacrylates to alcohols, and the like. (The reaction products of the ether-acids may contain the requisite hydrocarbyl groups provided that the groups exhibit substantially hydrocarbon character despite the presence of the ether functionality, as described above in the definition of "hydrocarbyl.") Mixtures of acids can also be used, e.g., isostearic acid and octadecyl succinic acid or octadecyl succinic anhydride, such mixtures being useful when reacted with an aminoalcohol such as ethanolamine.

The aminoalcohol may be a molecule that contains both amine functionality and alcohol functionality. The amine functionality may be in the form of a nitrogen atom containing at least one replaceable hydrogen, that is, a primary or secondary amine. Examples of amino alcohols that may be used may include trishydroxymethylaminomethane, 2-amino-2-ethyl-1,3-propanediol, and ethanol amine. Other amino alcohols that may be used may include 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenediamine, N,N-bis(2-hydroxyethyl)ethylenediamine, 1,3-diamino-2-hydroxypropane, N—N'-bis(2-hydroxyethyl)ethylenediamine, and 1-aminopropyl-3-diisopropanol amine. Mixtures of two or more of the foregoing amino alcohols may be used.

The two hydrocarbyl groups present in the friction modifier may originate from the hydrocarbyl portion of the acid reactant. In that case it is generally desirable that 2 moles of acid be reacted with 1 mole of the aminoalcohol, each of the two moles thereby providing one long chain hydrocarbyl group. This ratio may generally vary from about 1.2:1 to about 3:1, or from about 1.6:1 to about 2.5:1, or from about 1.9:1 to about 2.1:1. It is recognized that in any reaction product there may be a mixture of products, and reacting in any of the above ratios may lead to some 1:1 adduct, 2:1 adduct, 3:1 adduct, and so on, in statistical or other ratios depending in part on the relative amounts of the starting materials. The fact that the product may include a portion of the 1:1 adduct does not remove such a product from the scope of the present invention, provided that at least a portion of the product contains the required two hydrocarbyl groups. If two different species of acid are used, the ratios can be about 1:1:1, and so on; provided that the ratio of moles of all such acids to the moles of all the aminoalcohols will normally be about 2:1. Alternatively, if the aminoalcohol itself is the source of one long chain hydrocarbyl group, then a ratio of about 1:1 may be appropriate to provide the two hydrocarbyl groups per molecule.

The friction modifier (b) may comprise the reaction product of at least one carboxylic acid or equivalent with at least one polyamine. The carboxylic acid or equivalent may be an alkyl or alkenyl succinic acid or anhydride. The carboxylic acid or equivalent may be an isomerized alkenyl substituted succinic anhydride such as described in U.S. Pat. No. 5,750,476 at column 2, lines 15-39, and column 3, lines 17-55, this patent being incorporated herein by reference. The alkenyl groups may be hydrogenated to form their saturated alkyl analogs. The polyamine may comprise diethylene triamine, triethylene tetramine, tetraethylene pentamine, or a mixture of two or more thereof. The molar ratio of carboxylic acid or equivalent to polyamine may be about 2:1. The reaction conditions are disclosed in U.S. Pat. No. 5,750,476.

The friction modifier (c) may be viewed as the condensation product of a secondary amine with a hydroxy acid or thioacid. The amine may contain substituent hydrocarbyl groups, for example, alkyl groups. The amine may be represented by the formula $$R^1R^2NH$$

wherein $R^1$ and $R^2$ are each independently a hydrocarbyl group of at least about 6 carbon atoms (for example, from about 6 to about 30 carbon atoms, or from about 8 to about 24 carbon atoms, or from about 10 to about 20, or from about 10 to about 18, or from about 12 to about 16 carbon atoms). The $R^1$ and $R^2$ groups may be linear or branched, saturated or unsaturated, aliphatic, aromatic, or mixed aliphatic and aromatic. In certain embodiments they may be alkyl groups and in particular linear alkyl groups. The $R^1$ and $R^2$ groups may be the same or different. A commercial example of a suitable amine is sold under the trade name Armeen 2C™, which is believed to have two $C_{12}$ alkyl groups. In one embodiment the amine may comprise di-cocoalkyl amine or homologous amines. Di-cocoalkyl amine (or di-cocoamine) may be a secondary amine in which the two R groups in the above formula are predominantly $C_{12}$ groups (although amounts of $C_8$ through $C_{18}$ may be present), derived from coconut oil. In one embodiment, one or both of the groups $R^1$ and $R^2$ may be 2-ethylhexyl groups. In one embodiment, the amine moiety $R^1R^2N$— of the amide or thioamide may comprise a (2-ethylhexyl) (hydrogenated tallow) amine moiety, where the "hydrogenated tallow" moiety is derived from tallow, having predominantly $C_{18}$ groups. Commercially available dialkylamines may contain certain amounts of monoalkylamines and/or trialkylamines, and products formed from such commercial materials are contemplated to be within the scope of the present invention (recognizing that any trialkylamine component may not be expected to be reactive to form an amide.)

The friction modifier (c) may be the condensation product of the above-described amine with a hydroxy acid or hydroxy thioacid or reactive equivalent thereof. In the instance where X is O, the amide may be a derivative of a hydroxy acid which can be represented by the formula $R^3COOH$. In the hydroxy acid (or hydroxy thioacid, as the case may be) $R^3$ may be a hydroxyalkyl group of from 1 to about 6 carbon atoms or a group formed by the condensation of such hydroxyalkyl group, through the hydroxyl group thereof, with an acylating agent (which may include a sulfur-containing acylating agent). That is, the —OH group on $R^3$ may be itself potentially reactive and may condense with additional acidic materials or their reactive equivalents to form, e.g., esters. Thus, the hydroxy acid may be condensed, for instance, with one or more additional molecules of acid such as glycolic acid. An example of a suitable hydroxy acid is glycolic acid, that is, hydroxyacetic acid, HO—$CH_2$—COOH. Glycolic acid may be commercially available, either in substantially neat form or as a 70% solution in water. When $R^3$ contains more than 1 carbon atom, the hydroxy group may be on the 1 carbon (alpha) or on another carbon in the chain (e.g., beta). The carbon chain itself may be linear, branched or cyclic.

The friction modifier (d) may comprise a tertiary amine represented by the formula $$R^1R^2NR^3$$

wherein $R^1$ and $R^2$ are each independently an alkyl group of at least about 6 carbon atoms (e.g., from about 8 to 20 carbon atoms, or from about 10 to about 18, or from about 12 to about 16 carbon atoms) and $R^3$ is a polyhydroxyl-containing alkyl group or a polyhydroxyl-containing alkoxyalkyl group. In one embodiment, the amine may comprise a product of di-cocoalkyl amine or a homologous amine. Di-cocoalkyl amine (or di-cocoamine) is a secondary amine in which two of the R groups in the above formula are predominantly $C_{12}$ groups derived from coconut oil. In one embodiment, $R^3$ may be a polyol-containing alkyl group (that is, a group containing 2 or more hydroxy groups) or a group containing one or more hydroxy groups and one or more amine groups. For instance, $R^3$ may be —$CH_2$—CHOH—$CH_2$OH or a homologue thereof, containing, for example, from about 3 to about 8 carbon atoms, or from about 3 to about 6 carbon atoms, or from about 3 to about 4 carbon atoms, and 2, 3, 4 or more hydroxy groups (normally no more than one hydroxy group per carbon atom). A typical resulting product may thus be represented by the formula $$R^1R^2N—CH_2—CHOH—CH_2OH$$

or homologues thereof, where $R^1$ and $R^2$ may be, as described above, independently alkyl groups of from about 8 to about 20 carbon atoms. Such products may be obtained by the reaction of a dialkyl amine with an epoxide or halogenated hydroxy (e.g., chlorohydroxy, bromohydroxy and/or iodohydroxy) compound. In particular, reaction of a secondary amine with glycidol (2,3-epoxy-1-propanol) or "chloroglycerine" (that is, 3-chloropropane-1,2-diol) may be effective under conditions as described above. Such materials based on the reaction of dicocoamine with one or more moles of glycidol or chloroglycerine may be useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

The friction modifier (d) may alternatively be described, in certain embodiments, as a compound comprising a core portion comprising from about 3 to about 8 carbon atoms, (e.g., from about 3 to about 6, or about 3 carbon atoms), the core portion being substituted by: (i) at least two hydroxy groups, or at least one hydroxy group and at least one alkoxy group of 1 to about 4 carbon atoms wherein the alkoxy group is further substituted by at least one hydroxy group or another such alkoxy group; and (ii) at least one amino group, the nitrogen atom thereof bearing two hydrocarbyl groups, each hydrocarbyl group independently having from about 6 to about 30 carbon atoms.

Mixtures (e) of two or more of the friction modifiers (a), (b), (c) and (d) may be used.

The amount of friction modifier in the functional fluid may be an amount suitable to reduce or inhibit shudder in an automatic transmission, that is, a performance defect observed during clutch operation when the friction characteristics of the transmission fluid are inadequately balanced. The amount may be from about 0.25 to 5% by weight of the functional fluid. Alternative amounts may include from about 0.5 to about 5% by weight, or from about 1 to about 3% by weight. In a concentrate, the amounts will be proportionately higher.

The dispersant may comprise one or more "carboxylic dispersants."

These are described in many U.S. patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. No. 6,165,235.

The carboxylic dispersants may comprise one or more succinimide dispersants. These may be prepared by the reaction of a hydrocarbyl-substituted succinic anhydride (or reactive equivalent thereof, such as an acid, acid halide, or ester) with an amine. The hydrocarbyl substituent group may contain an average of at least about 8, or at least about 20, or at least about 30, or at least about 35 carbon atoms up to about 350, or up to about 200, or up to about 100 carbon atoms. The hydrocarbyl group may be derived from a polyalkene. The polyalkene may be characterized by an $\overline{M}_n$ (number average molecular weight) of at least about 500. The polyalkene may be characterized by an $\overline{M}_n$ of at least about 500, or at least about 700, or at least about 800, or at least about 900 up to about 5000, or up to about 2500, or up to about 2000, or up to about 1500. In one embodiment, $\overline{M}_n$ may vary from about 500, or about 700, or about 800, to about 1200 or about 1300. In one embodiment, the polydispersity ($\overline{M}_w/\overline{M}_n$) may be at least about 1.5.

The polyalkenes may include homopolymers and interpolymers of polymerizable olefin monomers of 2 to about 16 carbon atoms, or 2 to about 6 carbon atoms, or 2 to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the inter-polymer may be a homo-polymer. An example of a polymer that may be used is polybutene. In one embodiment, about 50% of the polybutene may be derived from isobutylene. The polyalkenes may be prepared by conventional procedures.

The succinic acylating agents may be prepared by reacting a polyalkene with an excess of maleic anhydride to provide substituted succinic acylating agents wherein the number of succinic groups for each equivalent weight of substituent group may be at least about 1.3, or at least about 1.5, or at least about 1.7, or at least about 1.8. The maximum number of succinic groups per substituent group may be up to about 4.5, or up to about 2.5, or up to about 2.1, or up to about 2.0. The preparation and use of substituted succinic acylating agents wherein the substituent is derived from such polyolefins are described in U.S. Pat. No. 4,234,435.

The substituted succinic acylating agent may be reacted with an amine, including those amines described above and heavy amine products known as amine still bottoms. The amount of amine reacted with the acylating agent may be an amount to provide a ratio of CO:N of about 1:2 to about 1:0.75. If the amine is a primary amine, complete condensation to the imide may occur. Varying amounts of amide product, such as the amidic acid, may also be present. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality may be present. These may be referred to as ester-amide dispersants.

The dispersant may be an amine dispersant. Amine dispersants may be reaction products of relatively high molecular weight aliphatic or alicyclic halides and amines, for example, polyalkylene polyamines. Examples thereof are described in the following U.S. Pat. Nos. 3,275,554, 3,438,757, 3,454,555, and 3,565,804.

The dispersant may be Mannich dispersant. Mannich dispersants are the reaction products of alkyl phenols in which the alkyl group contains at least about 30 carbon atoms with aldehydes (especially formaldehyde) and amines (especially polyalkylene polyamines). These are described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

The dispersant may be a post-treated dispersant. Post-treated dispersants may be obtained by reacting a carboxylic, amine or Mannich dispersant with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). These are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

Mixtures of two or more of any of the foregoing dispersants may be used.

The amount of dispersant in the functional fluid may range up to about 6% by weight (on an oil free basis) of the functional fluid, and in one embodiment in the range from about 1 to about 6% by weight. In one embodiment, the amount of dispersant may range from about 1.5 to about 5.5% by weight, or from about 2 to about 4% by weight. In a concentrate, the amounts will be proportionately higher.

The functional fluid may contain one or more viscosity modifiers and/or dispersant viscosity modifiers. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers and graft copolymers. The DVM may comprise a nitrogen-containing methacrylate polymer, for example, a nitrogen-containing methacrylate polymer derived from at least one alkylmethacrylate and dimethylaminopropyl methacrylamide.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ 7727™, LZ 7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration in the range up to about 20% by weight. Concentrations of about 1 to about 12%, or about 3 to about 10% by weight may be used.

The functional fluid may contain one or more supplemental friction modifiers. These friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

(i) fatty phosphites
(ii) fatty acid amides
(iii) fatty epoxides
(iv) borated fatty epoxides
(v) fatty amines other than the fatty amines discussed above
(vi) glycerol esters
(vii) borated glycerol esters
(viii) alkoxylated fatty amines
(ix) borated alkoxylated fatty amines
(x) metal salts of fatty acids
(xi) sulfurized olefins
(xii) fatty imidazolines
(xiii) condensation products of carboxylic acids and polyalkylene-polyamines
(xiv) metal salts of alkyl salicylates
(xv) amine salts of alkylphosphoric acids
(xvi) ethoxylated alcohols
and mixtures of two or more thereof.

Representatives of each of these types of friction modifiers are known and are commercially available. For instance, (i) fatty phosphites are generally of the formula $(RO)_2PHO$. Dialkyl phosphite, as shown in the preceding formula, may be present with a minor amount of monoalkyl phosphite of the formula (RO)(HO)PHO. In these structures, the term "R" is conventionally referred to as an alkyl group. It is, of course, possible that the alkyl may actually be alkenyl and thus the terms "alkyl" and "alkylated," as used herein, should be understood to embrace both saturated and unsaturated "alkyl" groups. The phosphite should have sufficient hydrocarbyl groups to render the phosphite substantially oleophilic. The hydrocarbyl groups may be branched or unbranched. Many suitable phosphites are available commercially and may be synthesized as described in U.S. Pat. No. 4,752,416. The phosphite may contain from about 8 to about 24 carbon atoms in each R group. The fatty phosphite may contain from about 12 to about 22 carbon atoms in each of the fatty radicals, or from about 16 to about 20 carbon atoms. In one embodiment, the fatty phosphite may be formed from oleyl groups, thus having 18 carbon atoms in each fatty radical.

(iv) Borated fatty epoxides that may be used are disclosed in Canadian Patent No. 1,188,704. These oil-soluble boron-containing compositions may be prepared by reacting, at a temperature from about 80° C. to about 250° C., boric acid or boron trioxide with at least one fatty epoxide having the formula

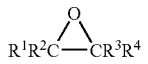

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide may contain at least about 8 carbon atoms.

The borated fatty epoxides may be characterized by the method for their preparation which involves the reaction of two materials, namely, reagents A and B. Reagent A may be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, may be used. Reagent B may be at least one fatty epoxide having the above formula. In the formula, each of the R groups may be hydrogen or an aliphatic radical with at least one being a hydrocarbyl or aliphatic radical containing at least about 6 carbon atoms. The molar ratio of reagent A to reagent B may be in the range from about 1:0.25 to about 1:4. Ratios of about 1:1 to about 1:3 may be used, with about 1:2 being useful. The borated fatty epoxides may be prepared by merely blending the two reagents and heating them at temperature in the range from about 80° to about 250° C., and in one embodiment from about 100° to about 200° C., for a period of time sufficient for reaction to take place. If desired, the reaction may be effected in the presence of a substantially inert, normally liquid organic diluent. During the reaction, water is evolved and may be removed by distillation.

(iii) Non-borated fatty epoxides, corresponding to "Reagent B" above, may be useful as supplemental friction modifiers.

Borated amines that may be used are disclosed in U.S. Pat. No. 4,622,158. Borated amine friction modifiers (including (ix) borated alkoxylated fatty amines) may be prepared by the reaction of a boron compounds, as described above, with the corresponding amines. The amine may be a simple fatty amine or hydroxy containing tertiary amines. The borated amines may be prepared by adding the boron reactant, as described above, to an amine reactant and heating the resulting mixture at a temperature in the range from about 50° to about 300° C., and in one embodiment from about 100° C. to about 250° C., and in one embodiment from 150° C. to about 230° C., with stirring. The reaction may be continued until byproduct water ceases to evolve from the reaction mixture indicating completion of the reaction.

The amines useful for preparing the borated amines may include commercial alkoxylated fatty amines known by the trademark "ETHOMEEN" and available from Akzo Nobel. Representative examples of these ETHOMEEN™ materials may include ETHOMEEN™ C/12 (bis[2-hydroxyethyl]-coco-amine); ETHOMEEN™ C/20 (polyoxyethylene-[10] cocoamine); ETHOMEEN™ S/12 (bis[2-hydroxyethyl] soyamine); ETHOMEEN™ T/12 (bis[2-hydroxyethyl]-tallow-amine); ETHOMEEN™ T/15 (polyoxyethylene-[5]

tallowamine); ETHOMEEN™ 0/12 (bis[2-hydroxyethyl] oleyl-amine); ETHOMEEN™ 18/12 (bis[2-hydroxyethyl]-octadecylamine); and ETHOMEEN™ 18/25 (polyoxyethylene[15]-octadecylamine). Fatty amines and ethoxylated fatty amines that may be useful are described in U.S. Pat. No. 4,741,848.

The (viii) alkoxylated fatty amines, and (v) fatty amines themselves (such as oleylamine) may be useful as friction modifiers. These amines are commercially available.

Both borated and unborated fatty acid esters of glycerol may be used as friction modifiers. The (vii) borated fatty acid esters of glycerol may be prepared by borating a fatty acid ester of glycerol with boric acid with removal of the water of reaction. There should be sufficient boron present such that each boron may react with from about 1.5 to about 2.5 hydroxyl groups present in the reaction mixture. The reaction may be carried out at a temperature in the range from about 60° C. to about 135° C., in the absence or presence of an organic solvent such as methanol, benzene, xylenes, toluene, or oil.

(vi) Fatty acid esters of glycerol themselves may be prepared by a variety of methods well known in the art. Many of these esters, such as glycerol monooleate and glycerol tallowate, are manufactured on a commercial scale. The esters useful may be oil-soluble and may be prepared from $C_8$ to $C_{22}$ fatty acids or mixtures thereof such as are found in natural products and as are described in greater detail below. Fatty acid monoesters of glycerol may be used, although, mixtures of mono- and diesters may also be used. For example, commercial glycerol monooleates may contain a mixture of about 45% to about 55% by weight monoester and about 55% to about 45% by weight diester.

Fatty acids may be used in preparing the above glycerol esters; they may also be used in preparing their (x) metal salts, (ii) amides, and (xii) imidazolines, any of which may also be used as friction modifiers. The fatty acids may contain from about 6 to about 24 carbon atoms, or from about 8 to about 18 carbon atoms. The acids may be branched or straight-chain, saturated or unsaturated. Suitable acids may include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A useful acid may be oleic acid. Metal salts may include zinc and calcium salts. Examples may include overbased calcium salts and basic oleic acid-zinc salt complexes which may be represented by the general formula $Zn_4Oleate_6O$. The amides may be those prepared by condensation with ammonia or with primary or secondary amines such as diethylamine and diethanolamine. Fatty imidazolines may include the cyclic condensation product of an acid with a diamine or polyamine such as a polyethylenepolyamine. The imidazolines may be represented by the structure

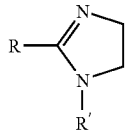

where R is an alkyl group and R' is hydrogen or a hydrocarbyl group or a substituted hydrocarbyl group, including —$(CH_2CH_2NH)n$— groups. In one embodiment, the friction modifier may be the condensation product of a $C_8$ to $C_{24}$ fatty acid with a polyalkylene polyamine, for example, the product of isostearic acid with tetraethylenepentamine. The condensation products of carboxylic acids and polyalkyleneamines (xiii) may be imidazolines or amides.

Sulfurized olefins (xi) are well known commercial materials that may be used as friction modifiers. These may include sulfurized olefins prepared in accordance with the teachings in U.S. Pat. Nos. 4,957,651 and 4,959,168. These may include a cosulfurized mixture of two or more reactants selected from (1) at least one fatty acid ester of a polyhydric alcohol, (2) at least one fatty acid, (3) at least one olefin, or (4) at least one fatty acid ester of a monohydric alcohol.

Reactant (3), the olefin component, may comprise at least one olefin. This olefin may be an aliphatic olefin, which may contain from about 4 to about 40 carbon atoms, or from about 8 to about 36 carbon atoms. Terminal olefins, or alpha-olefins, may be used. These may include those having from about 12 to about 20 carbon atoms. Mixtures of these olefins are commercially available, and such mixtures may be used.

The cosulfurized mixture of two or more of the reactants, may be prepared by reacting the mixture of appropriate reactants with a source of sulfur. The mixture to be sulfurized may contain from about 10 to about 90 parts of Reactant (1); or from about 0.1 to about 15 parts by weight of Reactant (2); or from about 10 to about 90 parts, or from about 15 to about 60 parts, or from about 25 to about 35 parts by weight of Reactant (3); or from about 10 to about 90 parts by weight of Reactant (4). The mixture may include Reactant (3) and at least one other member of the group of reactants identified as Reactants (1), (2) or (4). The sulfurization reaction may be effected at an elevated temperature with agitation and optionally in an inert atmosphere and in the presence of an inert solvent. The sulfurizing agents may include elemental sulfur, a hydrogen sulfide, sulfur halide plus sodium sulfide, or a mixture of hydrogen sulfide and sulfur or sulfur dioxide. From about 0.5 to about 3 moles of sulfur may be employed per mole of olefinic bonds.

Metal salts of alkyl salicylates (xiv) may include calcium and other salts of long chain (e.g. $C_{12}$ to $C_{16}$) alkyl-substituted salicylic acids.

Amine salts of alkylphosphoric acids (xv) may include salts of oleyl and other long chain esters of phosphoric acid, with amines. Useful amines may include oleylamine, 2-ethylhexylamine, methyoleylamine, dicocoamine, and mixtures of two or more thereof. Also included are tertiary-aliphatic primary amines, sold under the tradename Primene™.

The supplemental friction modifier may be used in addition to the friction modifier described above. The amount of the supplemental friction modifier used in the functional fluid may be in the range up to about 1.5% by weight of the functional fluid, and in one embodiment from about 0.1 to about 1.5% by weight, or from about 0.2 to about 1.0, or from about 0.25 to about 0.75% by weight. In one embodiment, the amount of the supplemental friction modifier may be present at a concentration up to about 0.2% by weight, or up to about 0.1% by weight, for example, from about 0.01 to about 0.1% by weight.

The functional fluid may also include at least one phosphorus acid, phosphorus acid salt, phosphorus acid ester or derivative thereof including sulfur-containing analogs. The phosphorus acids, salts, esters or derivatives thereof may include phosphoric acid, phosphorus acid, phosphorus acid esters or salts thereof, phosphites, phosphorus-containing amides, phosphorus-containing carboxylic acids or esters, phosphorus-containing ethers, and mixtures of two or more thereof. Phosphorus acid anhydrides may be used. In one embodiment, the phosphorus acid, ester or derivative may be an organic or inorganic phosphorus acid, phosphorus acid ester, phosphorus acid salt, or derivative thereof. The phosphorus acids may include the phosphoric, phosphonic, phosphinic, and thiophosphoric acids including dithiophosphoric acid as well as the monothiophosphoric, thiophosphinic and thiophosphoric acids. One group of phosphorus compounds that may be used are alkylphosphoric acid mono alkyl primary amine salts as represented by the formula

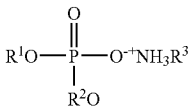

where $R^1$, $R^2$, $R^3$ are alkyl or hydrocarbyl groups or one of $R^1$ and $R^2$ can be H. A 1:1 mixture of dialkyl and monoalkyl phosphoric acid esters may be used. Compounds of this type are described in U.S. Pat. No. 5,354,484. Eighty-five percent (85%) phosphoric acid (which contains 15% by weight water) may be used. These may be used as phosphorus adjustment agents. The phosphorus adjustment agent may be added to the functional fluid at a concentration in the range from about 0.01 to about 3% by weight based on the weight of the functional fluid, and in one embodiment from about 0.03% to about 0.2%, or from about 0.03% to about 0.1% by weight.

Other materials can optionally be included in the functional fluids, provided that they are not incompatible with the afore-mentioned required components or specifications. These materials may include antioxidants (that is, oxidation inhibitors), including hindered phenolic antioxidants, secondary aromatic amine antioxidants, sulfurized phenolic antioxidants, oil-soluble copper compounds, phosphorus-containing antioxidants, organic sulfides, disulfides, and polysulfides. Other optional components may include seal swell agents, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Another material may be an antiwear agent such as one or more zinc dialkyldithiophosphates. These optional materials are known to those skilled in the art, are generally commercially available, and are described in greater detail in published European Patent Application 761,805. Also included can be known materials such as corrosion inhibitors, dyes, fluidizing agents, odor masking agents, and antifoam agents. Organic borate esters and organic borate salts may be included.

The above components can be in the form of a fully-formulated functional fluid or in the form of a concentrate within a smaller amount of lubricating oil. If they are present in a concentrate, their concentrations will generally be directly proportional to their concentrations in the more dilute form in the final blend. The concentrates may contain a reduced amount of oil, for example, from about 10% to about 50% by weight oil.

EXAMPLE

Formulations A-F are disclosed in Table 1. These formulations are useful as automatic transmission fluids. In Table 1, all numerical values are in parts by weight. All percentages are in percent by weight. Formulation C, which contains no detergent, is provided for purposes of comparison.

TABLE 1

| | A* | B | C | D | E | F |
|---|---|---|---|---|---|---|
| Dispersant | | | | | | |
| Polyisobutenyl succinimide containing boron and terephthalic acid (including 45% dil oil) | 3.70 | 3.90 | 5.00 | 4.75 | — | — |
| Polyisobutenyl succinimide containing boron, terephthalic acid and dimercaptothiadiazole (including 41.3% dil oil) | — | — | 1.30 | 1.25 | 4.48 | 4.49 |
| Dispersant Viscosity Modifier | | | | | | |
| Nitrogen-containing polymethacrylate (Including 26% dil oil) | | 3.75 | — | — | 6.00 | 6.00 |
| Nitrogen-containing polymethacrylate (including 65% dil oil) | | — | 2.20 | 2.40 | — | — |
| Friction Modifier | | | | | | |
| Reaction product of dicocoamine with glycolic acid. | 2.40 | 2.50 | 1.25 | 1.25 | 0.12 | 0.12 |
| Ethomeen T-12 (diethoxylated tallow amine) | — | — | 0.08 | 0.03 | — | — |
| Reaction product of isostearic acid with tetraethylene pentamine. | — | — | 0.17 | 0.21 | — | — |
| Reaction product of oleic acid with N-hydroxyethylethylene diamine. | — | — | 0.03 | 0.03 | — | — |
| Reaction product of dicocoamine and chloroglycerine | — | — | 0.55 | 0.45 | — | — |
| Dioleyl hydrogen phosphite | | 0.05 | 0.10 | 0.10 | — | — |
| Reaction product of isostearic acid and trishydroxymethyl amino methane | — | — | — | — | 1.25 | 1.25 |
| Detergent | | | | | | |
| 300 TBN calcium overbased sulfonate (including 50% dil oil) | 0.15 | — | — | 0.12 | 0.12 | 0.12 |

TABLE 1-continued

| | A* | B | C | D | E | F |
|---|---|---|---|---|---|---|
| 300 TBN calcium overbased sulfonate (including 42% dil oil) | — | 0.25 | — | — | 0.03 | 0.03 |
| 10 TBN calcium alkyl sulfonate (including 50% dil oil) | 0.84 | 0.70 | — | 0.24 | — | 0.80 |
| 165 TBN calcium overbased alkyl salicylate (including 40% dil oil) | 0.15 | — | — | — | — | 0.2 |
| 85 TBN calcium alkyl sulfonate (including 47% dil oil) | — | 0.175 | — | — | — | — |
| Anti Wear Agent | | | | | | |
| Dibutyl hydrogen phosphite | 0.20 | 0.20 | 0.20 | 0.20 | 0.20 | 0.20 |
| Antioxidant | | | | | | |
| Phenyl alpha naphthyl amine | 0.20 | — | — | — | — | — |
| Mono- and di-nonyl diphenyl amine | 0.40 | 0.60 | 0.90 | 0.90 | 0.80 | 0.80 |
| Dialkyl sulfide | — | — | 0.30 | 0.30 | 0.30 | 0.30 |
| Corrosion Inhibitor | | | | | | |
| Reaction product of alkyl mercaptan with 2,5-dimercaptothiadiazole | — | 0.099 | 0.09 | 0.08 | — | — |
| Tolyltriazole | — | — | 0.02 | 0.02 | — | — |
| Seal Swell Agent | | | | | | |
| 3-isodecyloxy sulfolane | 0.40 | 0.50 | 1.25 | 1.25 | 0.50 | 0.50 |
| Phosphorus Adjustment Agent | | | | | | |
| Phosphoric acid (including 15% water) | 0.04 | 0.10 | 0.14 | 0.11 | 0.10 | 0.10 |
| Pour Point Dispersant | | | | | | |
| Polymethacrylate (including 40% dil oil) | — | 0.20 | — | — | 0.20 | 0.20 |
| Polymethacrylate (including 50% dil oil) | — | — | 0.20 | 0.20 | — | — |
| Red Dye | — | — | 0.025 | 0.025 | — | — |
| Foam Inhibitor | 0.030 | 0.029 | 0.01 | 0.01 | 0.03 | 0.03 |
| Diluent Oil | 0.62 | 0.226 | 2.22 | 2.20 | 1.00 | 1.00 |
| Base Oil | | 90.5 | 84.0 | 83.9 | 85.00 | 84.00 |
| Metal Contributed to Functional Fluid by Detergent (wt %) | 0.050 | 0.056 | — | 0.020 | 0.018 | 0.050 |
| Basicity (TBN) contributed to Functional Fluid by Detergent (wt %) | 0.53 | 0.97 | — | 0.38 | 0.45 | 0.86 |

*The amounts of dispersant viscosity modifier and base oil in the formulation are chosen to make a fluid suitable for use as an automatic transmission fluid.

Formulations C and D are tested using the Ford Anti-Shudder Durability (ASD) test. This test determines the frictional characteristics and anti-shudder durability of a fluid through high-speed clutch engagements, low-speed aging and torque sweeps, as well as static breakaway measurements. The derivative of torque with respect to sliding speed versus test hours is reported. The results are shown in FIG. 1.

Figure 2:
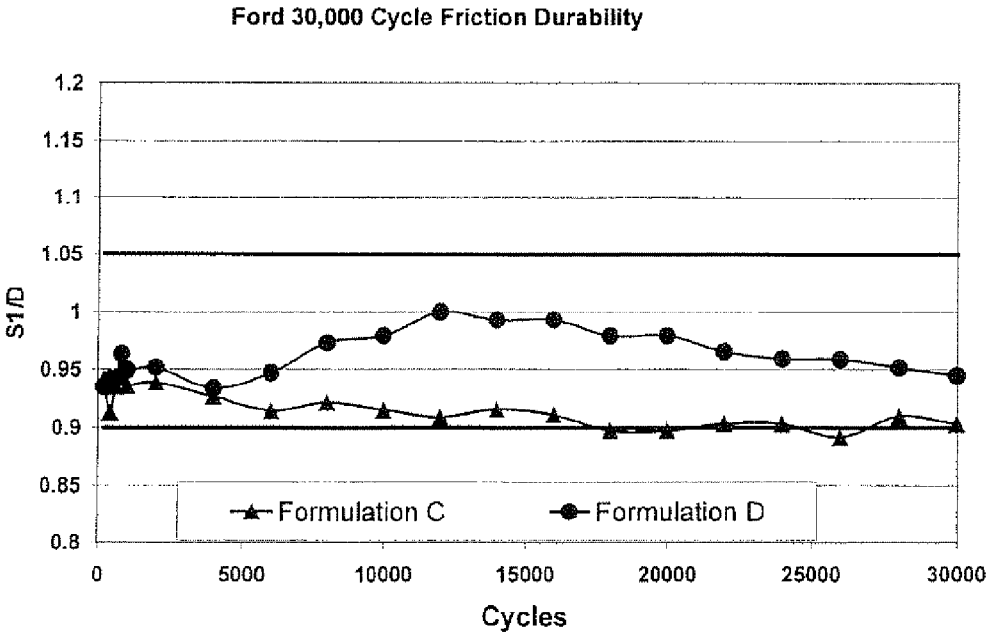
FIG. 2 is a graph showing the results of the Ford 30K Friction Durability Test for formulations C and D in the Example.

Formulations C and D are tested using the Ford 30K Friction Durability test. This test determines fluid frictional characteristics and friction durability over 30,000 clutch engagement cycles and reports dynamic and static torque measurements of the test fluid as well as static breakaway torque measurements over the duration of the test. The ratio of static torque over dynamic torque with respect to test cycles is reported. The results are shown in FIG. 2.

Figure 3:
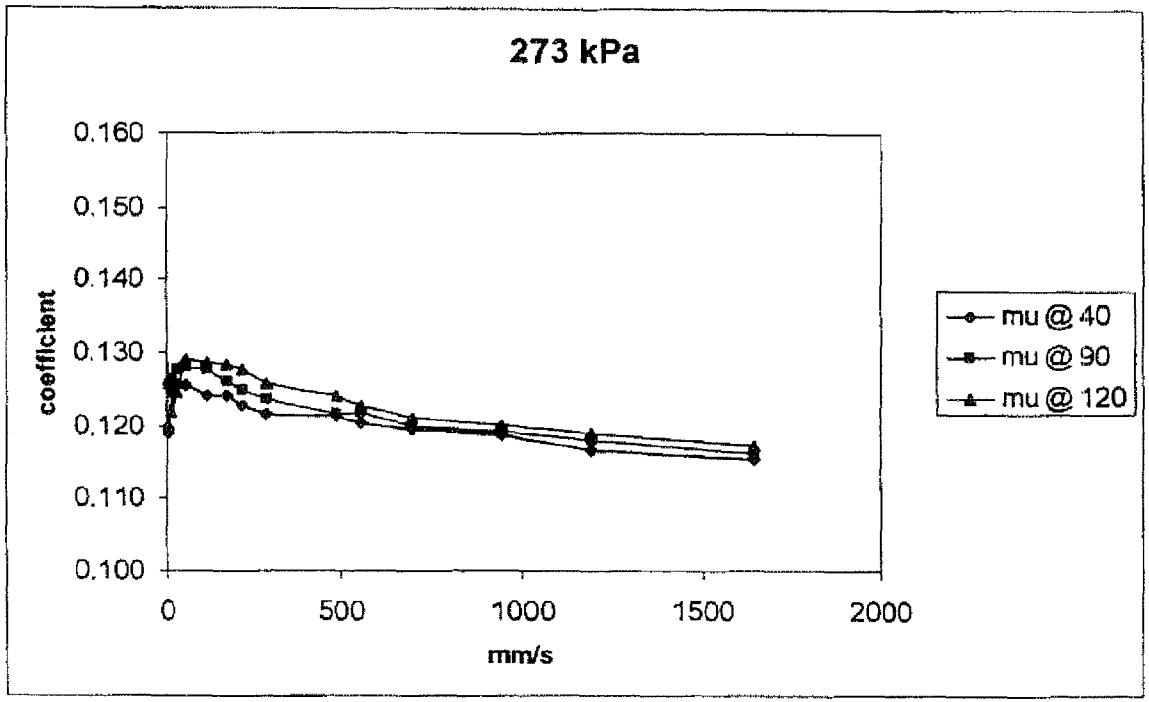
FIGS. 3-8 are graphs showing the results of the GM Low Speed Clutch and Torque Capacity Test for formulations C and D in the Example.
Figure 4:
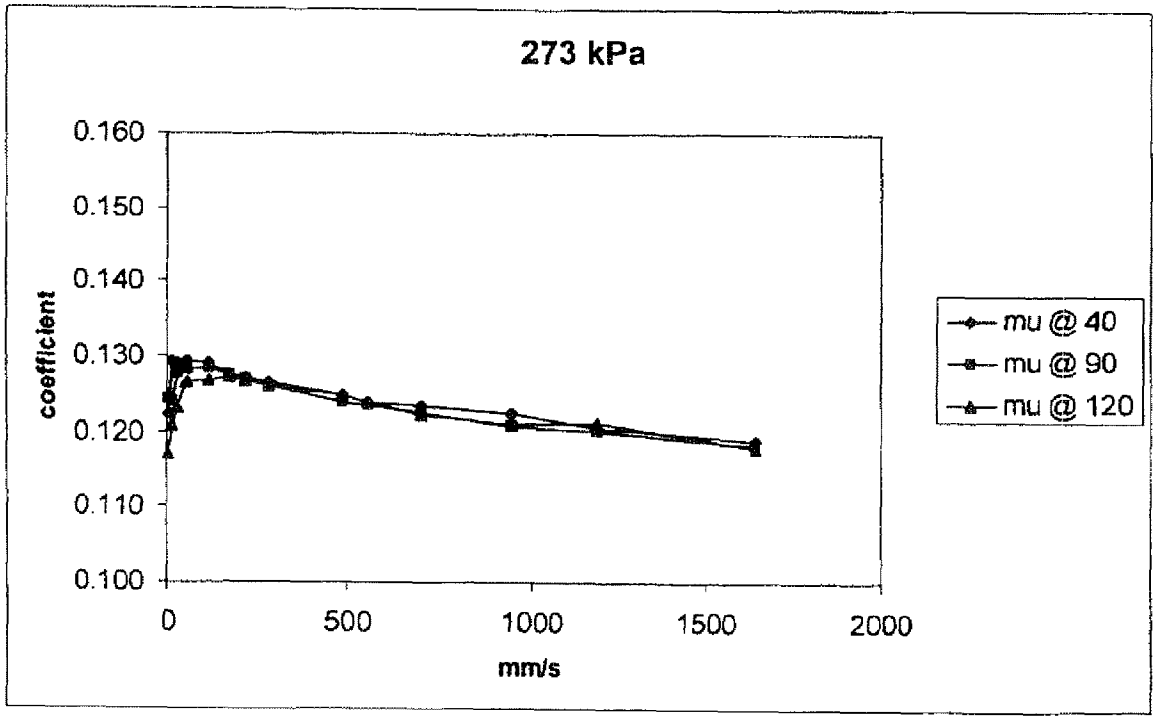
Figure 5:
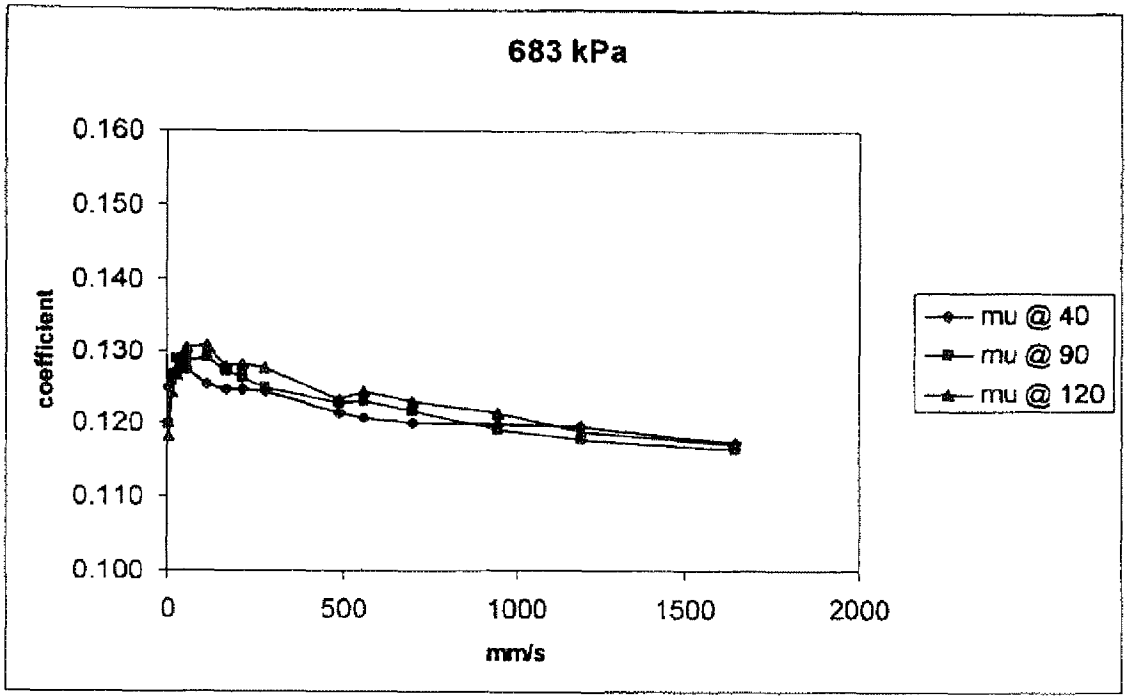
Figure 6:
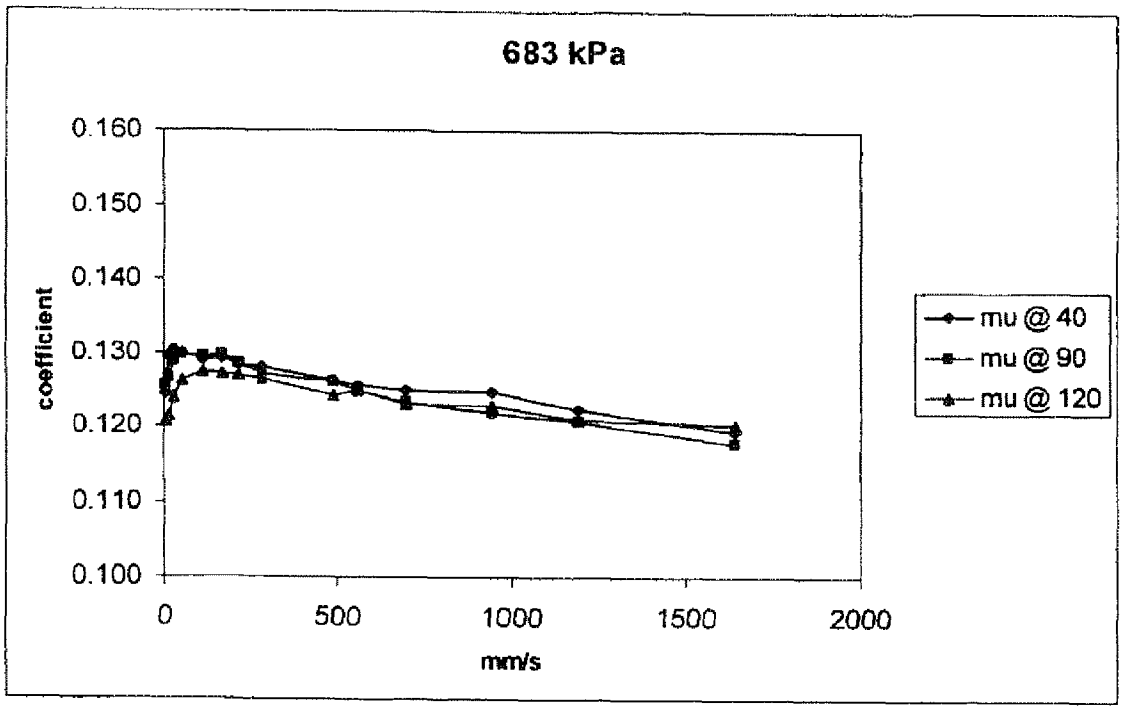
Figure 7:
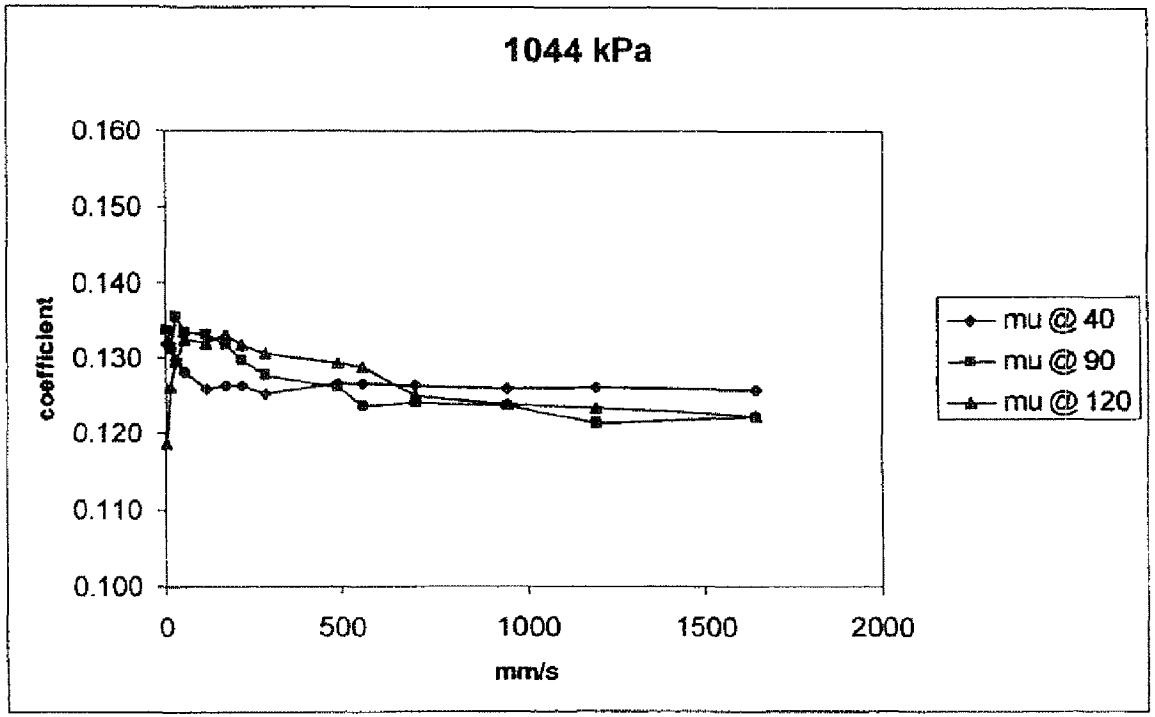
Figure 8:
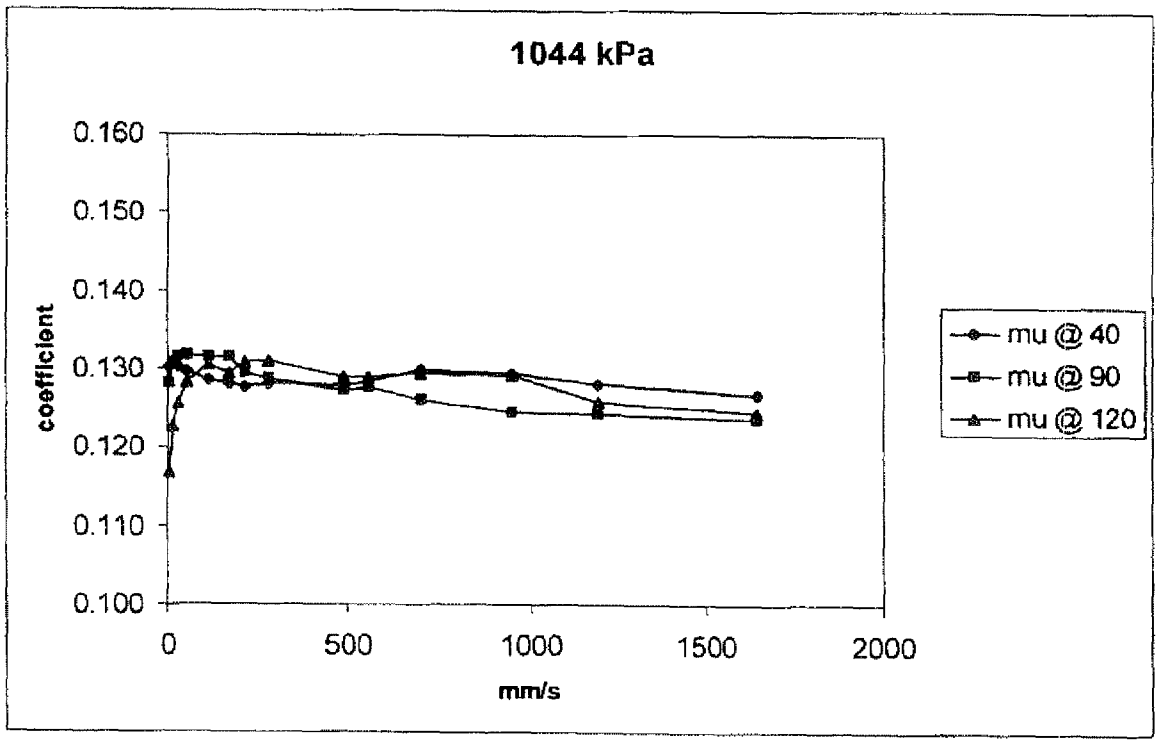

Formulations C and D are tested using the GM Low Speed Clutch and Torque Capacity test. This test determines the torque capacity, shudder tendency and gear hunting characteristics of an automatic transmission fluid on an electronically controlled converter clutch, carbon fiber friction material, at low rotational speeds. The results are reported as a graph of coefficient of friction with respect to sliding speed for various clutch clamping pressures at three temperatures. The results for Formulations C and D at low pressure (273 kPa) are shown in FIGS. 3 and 4, respectively. The results for Formulations C and D at a medium pressure (683 kPa) are shown in FIGS. 5 and 6, respectively. The results for Formulations C and D at a high pressure (1044 kPa) are shown in FIGS. 7 and 8, respectively.

Formulations E and F are tested using a Japanese Automotive Standards Organization (JASO) low velocity friction apparatus (LVFA) as prescribed in the JASO test procedure JASO M349:2001. This procedure uses a single friction plate and steel reaction plate. The friction plate is a Dynax D-0512 type composite material. Friction coefficients are determined at different sliding speeds and temperatures. The test cycle uses a series of sequential friction determinations at a series of speeds (u-v characterization test) after a series of 24 hr endurance cycles. The length of time to generate a negative slope or dμ/dv at 0.9 m/s slip time at 40° C. is useful for comparing the performance of oils. The test procedure uses a break-in period of 30 minutes at 80° C. This is followed by a determination of μ-v (coefficient of friction vs. sliding velocity) characteristics at 40° C., 80° C., and 120° C. using 1.0 MPa contact pressure. The speed is ramped from zero to 1.5 m/s, held for 1 second at 1.5 m/s, and then ramped to zero. The acceleration and deceleration times are 3 seconds.

The μ-v characteristics test is followed by an endurance test which is conducted for 24 hours. At the end of 24 hours a μ-v characteristics test is again run with the slope at 0.3 and 0.9 m/s being recorded. The conditions of the endurance cycle are 120° C., 0.9 m/s sliding speed, and 1.0 MPa contact pressure. The endurance test is conducted using repeated 30 minute intervals of sliding under pressure and temperature followed by a 1.0 minute rest period at temperature and no load. This cycle is repeated for 24 hours after which a μ-v characteristics measurement is made.

The cycle of 24 hr endurance and μ-v characteristics is continued until the slope or dμ/dv at 0.9 m/s becomes negative at which time the test is terminated. The total hours to negative μ-v slope is a measure of anti-shudder durability performance of the fluid.

The results are provided in Tables 2-5. The numerical values (other than test hours and temperature) are for the slope or dμ/dv. The pass/fail criteria relates to the time when the numbers become negative at 40° C. Larger time periods are better and higher positive numbers such as in Table 5 are acceptable.

The results for formulation E at 0.9 m/s are shown in Table 2.

TABLE 2

| Test Hours | 40° C. | 80° C. | 120° C. |
|---|---|---|---|
| 0 | 0.0 | −3.2 | −2.7 |
| 24 | 1.3 | −1.9 | −3.7 |
| 48 | 1.5 | −3.2 | −5.3 |
| 72 | −1.1 | −3.6 | −4.1 |
| 96 | −0.7 | −4.9 | −5.2 |
| 120 | −2.7 | −5.5 | −6.0 |

The results for formulation E at 0.3 m/s are shown in Table 3.

TABLE 3

| Test Hours | 40° C. | 80° C. | 120° C. |
|---|---|---|---|
| 0 | 3.7 | −2.6 | 1.5 |
| 24 | 0.8 | −2.5 | 3.2 |
| 48 | 2.9 | 1.3 | 3.2 |
| 72 | 0.7 | −1.2 | 0.8 |
| 96 | −2.0 | −3.0 | 3.1 |
| 120 | −4.4 | −4.6 | 1.7 |

The results for formulation F at 0.9 m/s are shown in Table 4.

TABLE 4

| Test Hours | 40° C. | 80° C. | 120° C. |
|---|---|---|---|
| 0 | 2.4 | −0.9 | −2.3 |
| 24 | 3.8 | 1.3 | −2.2 |
| 48 | 3.4 | 1.8 | −1.9 |
| 72 | 3.8 | 1.5 | −0.3 |
| 96 | 3.4 | 3.0 | −2.5 |
| 120 | 4.2 | 2.1 | −1.5 |
| 144 | 2.7 | 0.9 | −1.2 |
| 168 | 2.7 | 0.3 | −2.2 |
| 192 | 1.8 | −0.1 | −2.6 |
| 216 | 3.3 | 1.9 | −1.1 |
| 240 | 2.7 | 1.1 | −1.0 |
| 264 | 2.8 | 0.1 | −1.7 |
| 288 | 2.7 | −0.3 | −4.2 |
| 312 | 0.7 | 0.7 | −2.9 |
| 336 | 2.6 | −0.4 | −1.1 |
| 360 | 2.1 | −0.6 | −1.9 |
| 384 | 0.3 | −2.4 | −5.1 |
| 408 | −0.8 | −1.5 | −3.8 |

The results for formulation F at 0.3 m/s are shown in Table 5.

TABLE 5

| Test Hours | 40° C. | 80° C. | 120° C. |
|---|---|---|---|
| 0 | 6.4 | 2.7 | 4.7 |
| 24 | 8.9 | 7.8 | 7.3 |
| 48 | 12.0 | 9.3 | 7.7 |
| 72 | 11.4 | 11.1 | 7.3 |
| 96 | 13.1 | 8.7 | 10.2 |
| 120 | 10.3 | 10.4 | 9.6 |
| 144 | 11.2 | 8.9 | 12.1 |
| 168 | 8.7 | 8.6 | 9.7 |
| 192 | 10.2 | 9.5 | 10.8 |
| 216 | 10.5 | 7.4 | 9.0 |
| 240 | 11.4 | 8.4 | 7.6 |
| 264 | 9.5 | 7.4 | 7.8 |
| 288 | 9.9 | 9.8 | 11.8 |
| 312 | 8.9 | 7.6 | 9.9 |
| 336 | 8.3 | 9.0 | 5.4 |
| 360 | 6.4 | 5.5 | 6.0 |
| 384 | 5.0 | 3.5 | 5.3 |
| 408 | −1.7 | 5.2 | 6.7 |

While the disclosed technology has been explained in relation to various embodiments, it is to be understood that various modifications thereof may become apparent to those skilled in the art upon reading the specification. Therefore, it is to be understood that the invention disclosed herein is intended to cover such modifications as fall within the scope of the appended claims.

The invention claimed is:

1. A functional fluid comprising:

at least one oil of lubricating viscosity;

at least one detergent, the detergent contributing an amount of metal to the functional fluid equal to a concentration in the range from about 0.015 to about 1% by weight of the functional fluid, the detergent contributing an amount of basicity to the functional fluid equal to a total base number in the range from about 0.3 to about 2; and about 1 to about 3 percent by weight of at least one friction modifier, the friction modifier comprising at least two hydrocarbyl groups attached to a polar group or atom, the friction modifier being an amide represented by the formula $$R^1R^2N—C(X)R^3$$

wherein X is O, $R^1$ and $R^2$ are each independently hydrocarbyl groups, and $R^3$ is a hydroxyalkyl group or a group formed by the condensation of the hydroxyalkyl group, through a hydroxyl group thereof, with an acylating agent.

2. The functional fluid of claim 1 wherein the oil of lubricating viscosity comprises at least one natural oil, at least one synthetic oil, or a mixture of two or more thereof.

3. The functional fluid of claim 1 wherein the detergent comprises at least one neutral or overbased salt of at least one alkali and/or alkaline earth metal.

4. The functional fluid of claim 3 wherein the salt comprises one or more sulfonates, carboxylates, phenates, salicylates, or a mixture of two or more thereof.

5. The functional fluid of claim 1 wherein the two hydrocarbyl groups contain a total of at least about 8 carbon atoms.

6. The functional fluid of claim 1 wherein the friction modifier comprises the condensation product of a hydroxy acid with dicocoalkylamine.

7. The functional fluid of claim 1 wherein the functional fluid further comprises at least one carboxylic dispersant, amine dispersant, Mannich dispersant, post-treated dispersant or a mixture of two of more thereof.

8. The functional fluid of claim 1 wherein the functional fluid further comprises one or more viscosity modifiers and/or dispersant viscosity modifiers.

9. The functional fluid of claim 1 wherein the functional fluid further comprises at least one supplemental friction modifier, the supplemental friction modifier comprising one or more (i) fatty phosphites, (ii) fatty acid amides, (iii) fatty epoxides, (iv) borated fatty epoxides, (v) fatty amines, (vi) glycerol esters, (vii) borated glycerol esters, (viii) alkoxylated fatty amines, (ix) borated alkoxylated fatty amines, (x) metal salts of fatty acids, (xi) sulfurized olefins, (xii) fatty imidazolines, (xiii) condensation products of carboxylic acids and polyalkylene-polyamines, (xiv) metal salts of alkyl salicylates, (xv) amine salts of alkylphosphoric acids, or a mixture of two or more thereof.

10. The functional fluid of claim 1 wherein the functional fluid further comprises one or more of phosphorus acids, phosphorus acid salts, phosphorusacid esters, derivatives of one or more thereof, or a mixture of two or more thereof.

11. The functional fluid of claim 1 wherein the functional fluid further comprises at least one dispersant, viscosity modifier, dispersant viscosity modifier, friction stabilizing agent, phosphorus adjustment agent, antiwear agent, supplemental friction modifier, antioxidant, corrosion inhibitor, seal swell agent, pour point depressant, dye, fluidizing agent, odor masking agent, foam inhibitor and/or diluent oil.

12. The functional fluid of claim 1 wherein said detergent comprises at least one overbased calcium sulfonate and wherein said functional fluid is an automatic transmission fluid.

13. A concentrate for use in making a functional fluid, the concentrate comprising:

at least one oil of lubricating viscosity;

at least one detergent, the detergent being present in the concentrate at a concentration sufficient to contribute an amount of metal to the functional fluid equal to a concentration in the range from about 0.015 to about 1% by weight of the functional fluid, the detergent being present in the concentrate at a concentration sufficient to contribute an amount of basicity to the functional fluid equal to a total base number in the range from about 0.3 to about 2; and at least one friction modifier, the friction modifier comprising at least two hydrocarbyl groups attached to a polar group or atom, the friction modifier being an amide represented by the formula $$R^1R^2N—C(X)R^3$$

wherein X is O, $R^1$ and $R^2$ are each independently hydrocarbyl groups, and $R^3$ is a hydroxyalkyl group or a group formed by the condensation of the hydroxyalkyl group, through a hydroxyl group thereof, with an acylating agent.

14. The functional fluid of claim 1 wherein the detergent contributes an amount of basicity to the functional fluid equal to a total base number in the range from about 0.4 to about 1.

15. the funtional fluid of claim 1 further comprising a friction modifier comprising at least two hydrocarbyl groups attached to a polar group or atom, selected from (a) the reaction product of at least one carboxylic acid or equivalent with at least one aminoalcohol, (b) the reaction product of at least one carboxylic acid or equivalent with at least one palyamine, (d) at least one tertairy amine containing two hydrocarbyl groups and a polyhydroxyl-containing alkyl group or a polyhydroxyl-containing alkoxyalkyl group, or mixtures thereof.

* * * * *